United States Patent [19]

Lambert

[11] Patent Number: 5,016,379

[45] Date of Patent: May 21, 1991

[54] BLACK POWDER PERCUSSION NIPPLE

[75] Inventor: Fred R. Lambert, Mineral Wells, W. Va.

[73] Assignee: Mountain State Muzzleloading Supplies, Inc., Williamstown, W. Va.

[21] Appl. No.: 458,491

[22] Filed: Dec. 28, 1989

[51] Int. Cl.[5] ..... F41A 21/00

[52] U.S. Cl. ..... 42/83; 42/51

[58] Field of Search ..... 42/83, 51

[56] References Cited

U.S. PATENT DOCUMENTS

| | | | |
|---|---|---|---|
| 36,464 | 9/1862 | Hopkins | 42/51 |
| 92,398 | 7/1869 | Talbott | 42/83 |
| 4,114,303 | 9/1978 | Vaughn | 42/51 |
| 4,123,867 | 11/1978 | Peterson | 42/83 |
| 4,163,335 | 8/1979 | Ives | 42/83 |
| 4,186,506 | 2/1980 | Pawlak | 42/83 |
| 4,222,191 | 9/1980 | Lee et al. | 42/51 |

*Primary Examiner*—David H. Brown

*Attorney, Agent, or Firm*—Cushman, Darby & Cushman

[57] ABSTRACT

A percussion cap nipple for use with black powder firearms. The nipple includes a series of internal passageways that cooperate to produce a throughbore that directs the firing charge to the main powder charge in a fast and reliable manner yielding improved powder ignition. The base or exit end is flared to produce a wide spread of a greater quantity of sparks to the powder chamber. The inlet end is narrowed to form an anvil type end wall over which the percussion cap fits. This anvil cooperates with the hammer to assure positive detonation of the percussion cap.

9 Claims, 1 Drawing Sheet

BLACK POWDER PERCUSSION NIPPLE

FIELD OF THE INVENTION

The present invention concerns an improved percussion nipple for use with a variety of black powder firearms. It provides improved, quicker and more reliable ignition of the main powder charge while yielding better percussion cap detonation and longer performance.

BACKGROUND OF THE PRESENT INVENTION

For hundreds of years muzzle loaded firearms have relied upon use of an ignition orifice or port positioned adjacent the breech end of the barrel. This orifice or port allowed an ignition spark or flame to be transmitted from a point external of the gun barrel inside the barrel to the primary powder charge. This was followed, in most instances, by the explosion of that powder charge and the simultaneous expulsion of the bullet from the firearm.

It is well known that this process involved the rapid movement of sparks, a type of flame or hot gases. Over time this causes wear of the ignition ports. Further, it is also well known that the size and effective diameter of those ports vary appreciably with continued use and deteriorate over time. This deterioration is primarily due to the formation of a crust about the interior end of the orifice formed from powder residue that accompanies such use, that residue being comprised of the reaction between the charcoal, moisture, sulphur and nitrates from which the powder is comprised.

Various nozzle designs have been used in the past. One such design is shown in FIG. 1. This is a standard coned touchhole liner previously used only in flintlock guns. In flintlock weapons, the hammer included a piece of flint designed to strike a frizzen when the trigger was pulled. Most desirably this would produce one or more sparks adjacent the touchhole. The touchhole liner was made relatively large at its internal diameter so that the spark entering therein would be directed at the powder charge previously positioned in the breech end of the barrel. It was desirable to make the passageway from the flint to the powder charge as close as possible and frequently the exterior end of the touchhold liner would be filed down so that its exterior end lay flush with the exterior of the firearm.

These flintlock touchhole devices were not useful when the ignition system changed to use percussion caps. There was not a reduced portion on which the cap could be positioned and the percussion cap comprised a slightly different approach at ignition which required a different style and length nipple.

Various types of ignition nipples used with percussion caps are shown, for example, in U.S. Patents to Hopkins, U.S. Pat. No. 36,464, Talbott, U.S. Pat. No. 92,398, Vaughn, U.S. Pat. No. 4,114,303, Peterson, U.S. Pat. No. 4,123,867, Ives, U.S. Pat. No. 4,163,335 and Pawlak et al, U.S. Pat. No. 4,186,506.

The nipple shown in Hopkins screws into the breech end of the barrel and appears to include an internal passageway that is comprised of two tapered sections that join directly with one another at a point central along the bore. Talbott begins with a short small diameter cylindrical bore, similar to the touchhole liner, with the bore then flaring outwardly into an elongated, conically shaped section adjacent the base end of the nipple structure. Each of the more recent designs in Vaughn, Peterson, Ives and Pawlak et al show the concept of starting with a relatively large diameter primary chamber which terminates at a very small diameter bore that leads into the breech end of the barrel.

It is common that these nipples all screw into one or more types of mounting blocks, each of which includes an internal passageway that in turn leads to the primary powder charge. These mounting blocks can either be of the bolster type, a drum type or a mule ear (side slapper) type.

One problem associated with ignition nipples available today relates directly to the small size of the bores at the base of such nipples. Peterson attempts to overcome bore wear problems by employing an insert sleeve formed from a material which exhibits improved wear properties due to the use of a heat and wear resistant material. However, the area around the small diameter bore at the base of the nipple inevitably crests over due to powder residue buildup restricting flow through that small bore. This reduces the time the nipple remains useful and limits the effective diameter of that bore which leads to unreliable ignition and poses potential safety hazards.

SUMMARY OF THE PRESENT INVENTION

In accordance with the present invention, the black powder ignition nipple provides a unique through bore that assures reliable operation, provides a self-cleaning base or interior end and includes an improved, anvil type cap seat which assures positive detonation of the cap and makes detonation of that cap more easily achieved.

The new design for the internal bore, according to the present invention, provides a base end having a relatively wide opening so that the sparks flowing therethrough are provided to the main powder chamber in a faster and more dependably manner. The through bore includes an intermediate flame port provided between the primary chamber in which cap detonation initially occurs and the base chamber. This flame port not only helps maintain the firing pressure within the barrel but is positioned at a point along the axial length of the nipple so that it is within the confines of the mounting end of the nipple. This helps assure that radial forces generated during firing are effectively contained, assuring safe and long term reliable operation.

The inlet end over which the cap is retained has been reduced in size so that a narrowed end wall is created. This narrowed end wall provides a relatively sharp anvil against which the cap will sit. This anvil assumes positive cap detonation and improves the reliability of the ignition process.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EMBODIMENT OF THE PRESENT INVENTION

Figure 1:
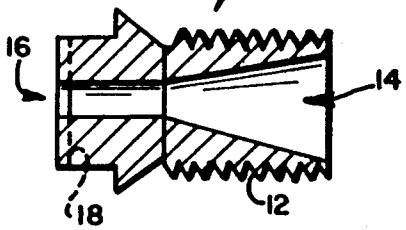
FIG. 1 is a cross-sectional view of a coned, flintlock touchhole liner.

As explained previously, and as shown in FIG. 1, flintlock firearms relied upon the creation of a spark on the exterior of the weapon which then had to pass through a touchhole adjacent the spark pan. This hole led directly to the powder charge in the breech end of the barrel. The liner itself, generally indicated at 10, included a threaded mounting section 12, a relatively large exit port 14 and a relatively small inlet port 16. The touchhole liner 10 included a slot or groove 18 formed across the inlet end providing a way to screw the device into or out of the breech end of the firearm. The inlet port 16 was usually provided within that slot or groove.

Figure 2:
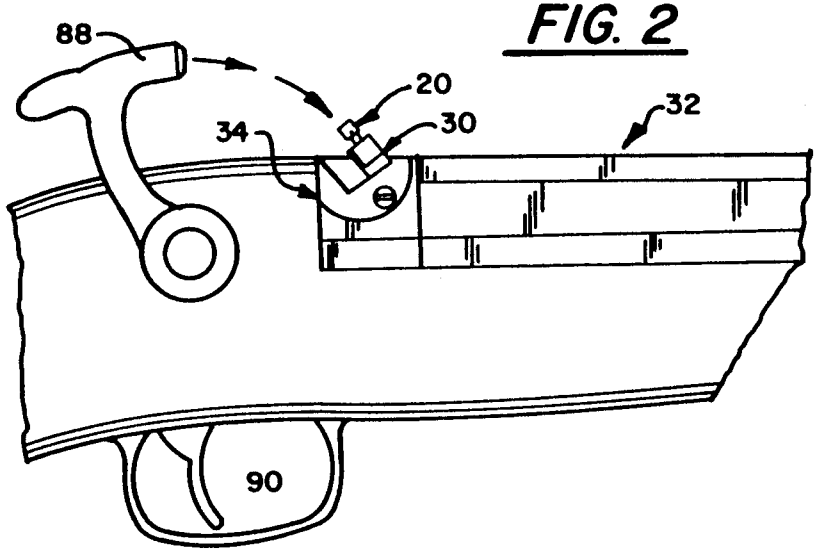
FIG. 2 is a fragmentary view of a black powder firearm showing the position of the nipple according to the present invention.
Figure 3:
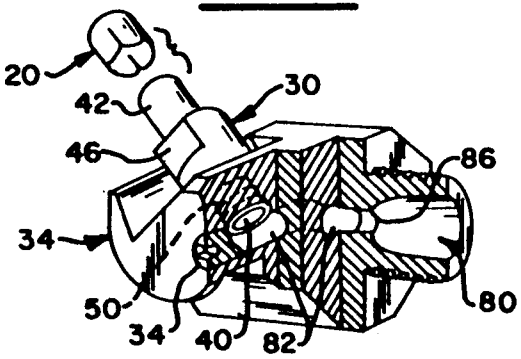
FIG. 3 is a view of a standard bolster type ignition element from which portions have been cut away for illustration purposes only.

This device was not found useful with percussion caps which needed a more elongated nipple structure. Further, the inlet end had to be reduced in diameter and had to extend outwardly away from the barrel so that it could slidingly receive a percussion cap thereover. With reference to FIGS. 2 and 3, a percussion cap is shown at 20.

The nipple according to the present invention is generally shown in FIGS. 2–5 at 30. As shown in FIG. 2, nipple 30 can be mounted to a firearm 32 and specifically within one of the standard types of a mounting block, one of which is generally indicated at 34. The mounting block shown at 34 is a bolster type. Another type is referred to as a drum type. This drum type is comprised of an elongated cylindrical member having an elongated interior chamber or base. The cylindrical member screws into the breech end of the barrel and the interior bore opens directly into the main powder charge. The exterior of the interior chamber is plugged by a clean out screw and the percussion nipple screws into the side wall of the cylindrical member with its base end lying within the interior chamber.

The nipple according to the invention includes an elongated body 36 that begins at a first or inlet end 38, and terminates at a second or outlet end 40.

Inlet end 38 includes a reduced diameter cap receiving portion 42. The center portion 44 of the body 36 includes two outwardly facing, parallel-planar surfaces, such as shown at 46 in FIGS. 3–5, by which the nipple itself can be tightened in place. The elongated body 36 also includes a mounting portion 48 comprised of externally formed threads so that the nipple can screw into a bore 50 provided within mounting block 34.

With reference again to FIG. 5, the inlet end 38 is provided with an end wall 52 which has a narrowed, annular face. This face is formed by having the exterior or outside wall of portion 42 bevelled or chamfered as at 54. The nipple structure includes a primary, hollow interior chamber 56 with the interior surfaces adjacent the inlet of that chamber also being beveled or chamfered as shown at 58. The combination of the bevelled surfaces 54, 58 produce the narrowed end wall 52 which acts like an anvil. It is against this end wall which the cap 20 can fit. During firing that narrowed end wall or surface assures a more positive detonation of the explosive charge contained within the cap.

The primary chamber 56 terminates at a conically shaped or tapered interior end 60 that narrows down to a flame port 62 which, in turn, opens into a second chamber at the base or exit end of the nipple. Immediately downstream of flame port 62 is a second tapered or cone shaped section shown at 66 that merges with a cylindrical portion 67 of the second chamber 64. The second chamber 64 terminates with a tapered or flared section 68, which in cooperation with threads 48 produces an end wall 70 therebetween.

The nipple according to the present invention is preferably comprised of stainless steel although a wide variety of metals, alloys, or other materials, including man made materials, could be used so long as they are heat and wear resistant and will withstand the temperatures, chemical effects and pressures associated with firearm ignition.

With reference to FIG. 3, mounting block 34, of which nipple 30 is threadably attached, includes a powder chamber 80 into which an L-shaped passage 82 opens. Passage 82 provides fluid communication between the base or discharge end 40 of nipple 30 to the powder chamber 80 and, of course, the main powder charge. As shown, the exterior end of passageway 82 is blocked with a clean-out set screw 84. Similarly, the opposite end of passageway 82 opening into chamber 80 can be tapered as indicated at 86 to form an outlet port into powder chamber 80. Consequently, when hammer 88, shown in FIG. 2, is actuated by trigger 90, the hammer will fall onto cap 20. The impact cap 20 is resisted by the anvil surface 52 and in cooperation with the hammer causes detonation if the cap 20. The resulting explosive charge passes into the primary chamber 56, through flame port 62 and on through the second chamber 64. The charge then moves through passageway 82 and into contact with the main powder charge within powder chamber 80 located within the breech end of the barrel.

Figure 4:
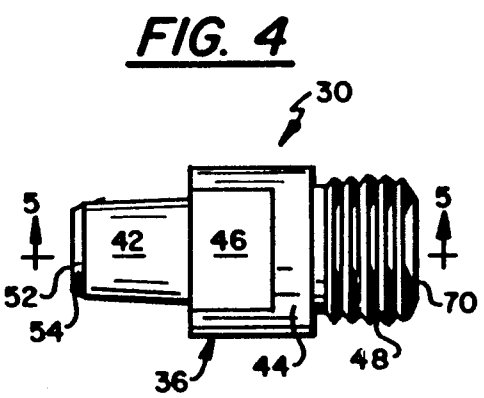
FIG. 4 is a side elevational view of the nipple according to the present invention.
Figure 5:
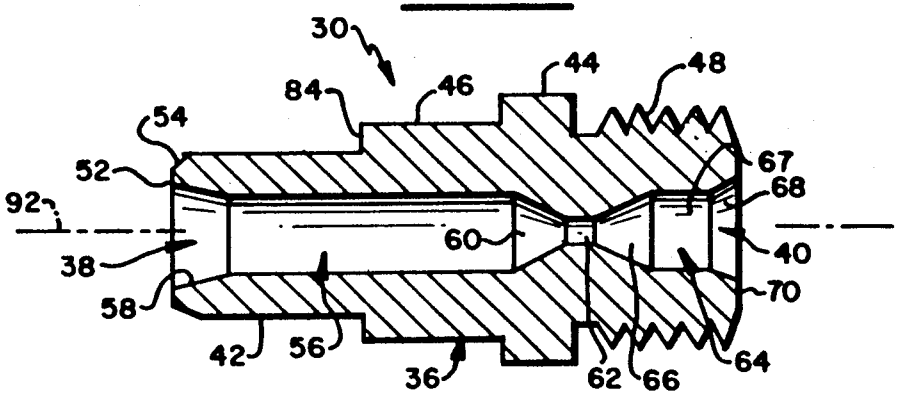
FIG. 5 is a cross-sectional view taken along line 5—5 in FIG. 4.

As shown in FIG. 5, flame port 62 is located on the mounting side of the center portion 44. While the exact location of port 62 can vary, it is desired that the flame port 62 will be fully mounted within mounting block 34 when nipple 30 is itself correctly mounted in place. This assures that the port 62 will lie within the confines of the threaded bore 50 of mounting block 34 so that radical forces created during firing will be resisted by block 34.

The exit end 40 of nipple 30 is provided with the flared opening as at 68 which reduces the exposed end wall or surface 70 at the base or interior end of nipple 30. This provides a surface which sheds rather than accumulates a buildup of powder residue. In fact, this narrowed end wall 70 exhibits a self-cleaning characteristic so that as firing continues powder residue that would be expected to accumulate tends to be burned off. The enlarged second chamber 64 permits the firing charge to move through to passageway 82 very rapidly, helps to maintain the passage fully open and end wall 70 provides further assistance in maintaining the desired operating dimensions of the nipple.

The primary chamber 56 has a diameter preferably of about 0.093 inches (±0.005 inches). The flame port preferably has an axial depth along axis 92 of about 0.093 inches but can range from about 0.085 to 0.100 inches. The second chamber 64, and in particular the diameter of the cylindrical section 67, is preferably about 0.125 inches (±0.005 inches) and the axial depth of the portions of the second chamber including sections 67 and 68 is approximately 0.125 inches. The nipple itself has an overall axial length of about 0.600 inches with the length of the mounting portion, from the entrance to flame port 62 to end wall 70, being approximately 0.200 inches. The axial length of wall portion 42 from end wall 52 to shoulder 94 is approximately 0.235 inches and the remaining length of the center portion 44 being approximately 0.165 inches.

The tapered sections 60 and 66 preferably have side walls tapered at an angle ranging from 30° to 45°. The beveling of section 68 is preferably about 30°, plus or minus 5° and this can also be the angle of bevel 54. The bevel or chamfer at 58 is preferably about 12°, plus or minus 5°. In addition, the diameter of port 62 is preferably about 0.031 inches.

The design of the present invention provides a very efficient mechanism through which sparks or fire can be transmitted to the powder charge in muzzle loading firearms. The coned base chamber 64 permits more sparks to flow and in a wide spread pattern into the powder chamber providing surer and more reliable ignition of the powder charge. As more sparks reach the main powder charge, there is an increased ability of those sparks creating a quicker and more dependable ignition of that main powder charge. Further, the structure of the end wall 70 creates a self-cleaning structure and resists powder residue buildup. This provides a longer period of accurate flow. Further, the small diameter fire port 62 prevents excess gas from escaping backwards through the nipple during firing yet permits positive and more consistent ignition.

The present design provides a longer operating life for the nipple due to the lack of powder residue buildup. Further, because the fire port is built into the center of the body of the nipple, heat can be dissipated and be transferred to the block and firearm. This also aids in lengthening the operating life of the nipple. Because of the consistent and strong flow patterns created by this nipple structure, burning of the main powder charge is cleaner and provides more consistent performance in having the ignition charge reach the powder in the barrel. Thus, surer and faster ignition of the main powder charge result.

While the invention has been described in connection with what is presently considered to be the most practical and preferred embodiment, it is to be understood that the invention is not to be limited to the disclosed embodiment, but on the contrary, is intended to cover various modifications are equivalent arrangements included within the spirit and scope of the appended claims.

What is claimed is:

1. A percussion nipple for use with black powder firearms comprised of an elongated body having a first end for slidably receiving a percussion cap thereover and a second end, the exterior of which is threaded for mounting to the firearm, said body including means defining a primary hollow chamber extending axially inwardly from said first end and having a first diameter, means defining a second hollow chamber extending axially inwardly from said second and end having a second diameter larger than said first diameter, means defining an interconnecting port in fluid communication with both the primary and second chambers and having a third diameter smaller than said first diameter so that said port and said primary and second chambers together form a through bore within said body.

2. The nipple as in claim 1 wherein the majority of the primary chamber wall having a first thickness and wherein said first end includes an annular end wall having a width dimension less than said first thickness.

3. The nipple as in claim 1 wherein said second chamber includes an outwardly flaring, conically shaped portion adjacent said second end.

4. The nipple as in claim 3 wherein said first end includes an annular end wall having a thickness that is narrowed relative to the thickness of the remaining wall surrounding said primary chamber.

5. The nipple as in claim 4 wherein at least one side of said first end is bevelled to form the narrowed annular end wall.

6. The nipple as in claim 4 wherein said first end further includes inner and outer side walls with each side wall being beveled toward one another to form the narrowed annular end wall.

7. The nipple as in claim 6 wherein said body further includes conically shaped wall sections on each side of and narrowing toward said port.

8. The nipple as in claim 7 wherein said primary and secondary chambers include cylindrical wall sections.

9. The nipple as in claim 7 wherein said second chamber further includes a section positioned between said outwardly flaring portion and said conically shaped wall section defined by an interim wall extending substantially parallel with the exit of said second chamber.

* * * * *